US006270006B1

(12) United States Patent
Bright et al.

(10) Patent No.: US 6,270,006 B1
(45) Date of Patent: Aug. 7, 2001

(54) CONTAINER

(76) Inventors: Stephen James Bright; Ron Hartley Ford, both of P.O. Box 702, Murwillumbam, NSW (AU), 2484

( * ) Notice: Subject to any disclaimer, the term of this patent is extended or adjusted under 35 U.S.C. 154(b) by 0 days.

(21) Appl. No.: 09/415,316

(22) Filed: Oct. 8, 1999

(51) Int. Cl.[7] ..... B65D 5/72

(52) U.S. Cl. ..... 229/122; 206/804; 206/817; 221/226; 221/279

(58) Field of Search ..... 229/122, 235; 206/804, 817; 221/226, 279, 280; 53/260

(56) References Cited

U.S. PATENT DOCUMENTS

| | | | | |
|---|---|---|---|---|
| 381,889 | * | 4/1888 | Scott | 206/804 |
| 866,243 | * | 9/1907 | Waechter | 206/804 |
| 1,332,420 | * | 3/1920 | Ward | 206/804 |
| 2,474,166 | * | 6/1949 | Rumsey, Jr. | 229/122 |
| 3,357,597 | * | 12/1967 | Groff | 221/279 |
| 3,399,762 | * | 9/1968 | Potter | 206/804 |
| 3,589,505 | * | 6/1971 | Burniski | 206/804 |
| 4,646,937 | | 3/1987 | Doshi . | |
| 4,942,961 | * | 7/1990 | Focke et al. | 206/804 |
| 5,467,894 | * | 11/1995 | Altonen et al. | 206/804 |

FOREIGN PATENT DOCUMENTS

| | | |
|---|---|---|
| 22441/29 | 3/1930 | (AU) . |
| 16481/95 | 8/1996 | (AU) . |
| 2629800 | 10/1989 | (FR) . |
| 221360 | 9/1924 | (GB) . |
| 243971 | 10/1925 | (GB) . |
| 407118 | 3/1934 | (GB) . |
| 881700 | 11/1961 | (GB) . |
| 1582431 | 1/1981 | (GB) . |
| 326101 | 3/1990 | (GB) . |

* cited by examiner

*Primary Examiner*—Gary E. Elkins
(74) *Attorney, Agent, or Firm*—Dann, Dorfman, Herrell and Skillman; Stephen H. Eland

(57) ABSTRACT

This invention relates to an improved container which may be used to store ten parcels arranged end to end and in two rows, one on top of the other. The container includes a top wall, a bottom wall, opposing side walls, and opposing front and rear walls respectively. The container also includes an advancement mechanism for advancing the rearmost parcels in the container so as to fill the void created by the removal of the foremost parcels. The advancement mechanism includes an enlarged end portion located behind the rearmost parcels and an intermediate portion located intermediate to the two rows of parcels.

16 Claims, 19 Drawing Sheets

CONTAINER

RELATED APPLICATIONS

This application is a continuation of International Patent Application No. PCT/AU98/00254 filed Apr. 14, 1998, which claims priority to Australian Patent Application No. PO6124, filed Apr. 10, 1997.

This invention relates to a container.

This invention has particular but not exclusive application to containers used for storing and displaying articles packaged in a sachet form, and for illustrative purposes reference will be made to such application. However, it will be appreciated that this invents on could be used in other applications where it is desired to store and display goods in containers and wherein the goods are arranged in one or more vertical rows.

Typically goods sold through supermarkets and similar retail outlets are delivered to retailers in containers which usually contain more than ones sample of. The goods. The containers are typically manufactured from paper card in a manner whereby often the front wall and sometimes at least a portion of the top wall of the container may be readily and easily removed so as to reveal the goods contained therein.

Often in order to save time associated with the stocking of shelves and such like, the containers referred to above are placed directly on the shelves in an "open state," such that consumers may easily avail themselves of the goods. Typically the width of the shelves is such that one or more additional containers may be stored immediately behind the opened container such that when the stock contained in the open container has been removed the container may be retrieved from the shelf and replaced by a container stored behind same.

Due to the small size of some goods, the container used to store and display said goods is often configured such that it may accommodate two or more rows of goods arranged side by side as well as additional vertical rows. Hence as goods are removed from the container the resulting void permits consumers to extend their hand into the confines of the container so as to access the rearmost goods.

However, it will be appreciated that the storage of larger numbers of goods on retailers shelves represents a significant expenditure on the part of the producer/retailer and wherein some of the stock due to the length of time it may sit on the shelves may exceed limits imposed on the shelf life of the product. Furthermore, excessive amounts of stock stored on retailers shelves may also be more susceptible to damage and theft.

It will also be appreciated that the space on retailers shelves occupied by excessive quantities of the same goods limits both the variety and selection of goods which the retailer may display.

The present invention aims to alleviated at least some of the disadvantages referred to above and to provide a container which will be reliable and efficient in use. Other objects and advantages of this invention will hereinafter become apparent.

With the foregoing and other objects in view, this invention in one aspect resides broadly in a container for storing a plurality o f articles therein , said articles being arranged within said container one behind the other, said container including:

a top wall;

a bottom wall;

spacing means adapted to maintain said top wall in a desired spaced relationship relative to said bottom wall, and promotion means for promoting the rearmost articles in a generally forward direction so as to fill the void formed by the removal of the foremost articles from the container.

The container may be made from any suitable material. For example the container may be made from a variety of wooden, metal, or plastics materials. However preferably the configuration of the container is such that it may be readily assembled from a blank state and as such the container may be constructed from paper card.

The spacing means may comprise one or more members integral with or attachable to the top and bottom walls. For example, the spacing means may comprise a plate like member which extends the length of the container and forms a side wall thereof.

The container may also include front and/or rear walls and wherein the container when assembled may be adapted to encapsulate the articles stored therein.

The promotion means may comprise and elongate member which is free to move relative to the bottom wall of the container in a generally forward direction and which in use may be adapted to engage the rear most upper and/or lower article and/or other articles resting on said elongate member. The elongate member may include one or more upstanding portions which way be located behind articles stored in the container.

In one embodiment the elongate member may be manufactured from a substantially rigid material such as thick paper card. Alternatively, the elongate member may be rather flexible and for example may be constructed from thin paper card, a length of ribbon or a piece of string. The elongate member may also include one or more weakened portions located discretely along the length thereof and wherein the foremost portions of said elongate member may be detached therefrom when no longer required. Furthermore, the elongate member may be tethered to the container.

In order that this invention may be more easily understood and put into practical effect, reference will now be made to the accompanying drawings which illustrate a preferred embodiment of the invention, wherein.

Figure 1:
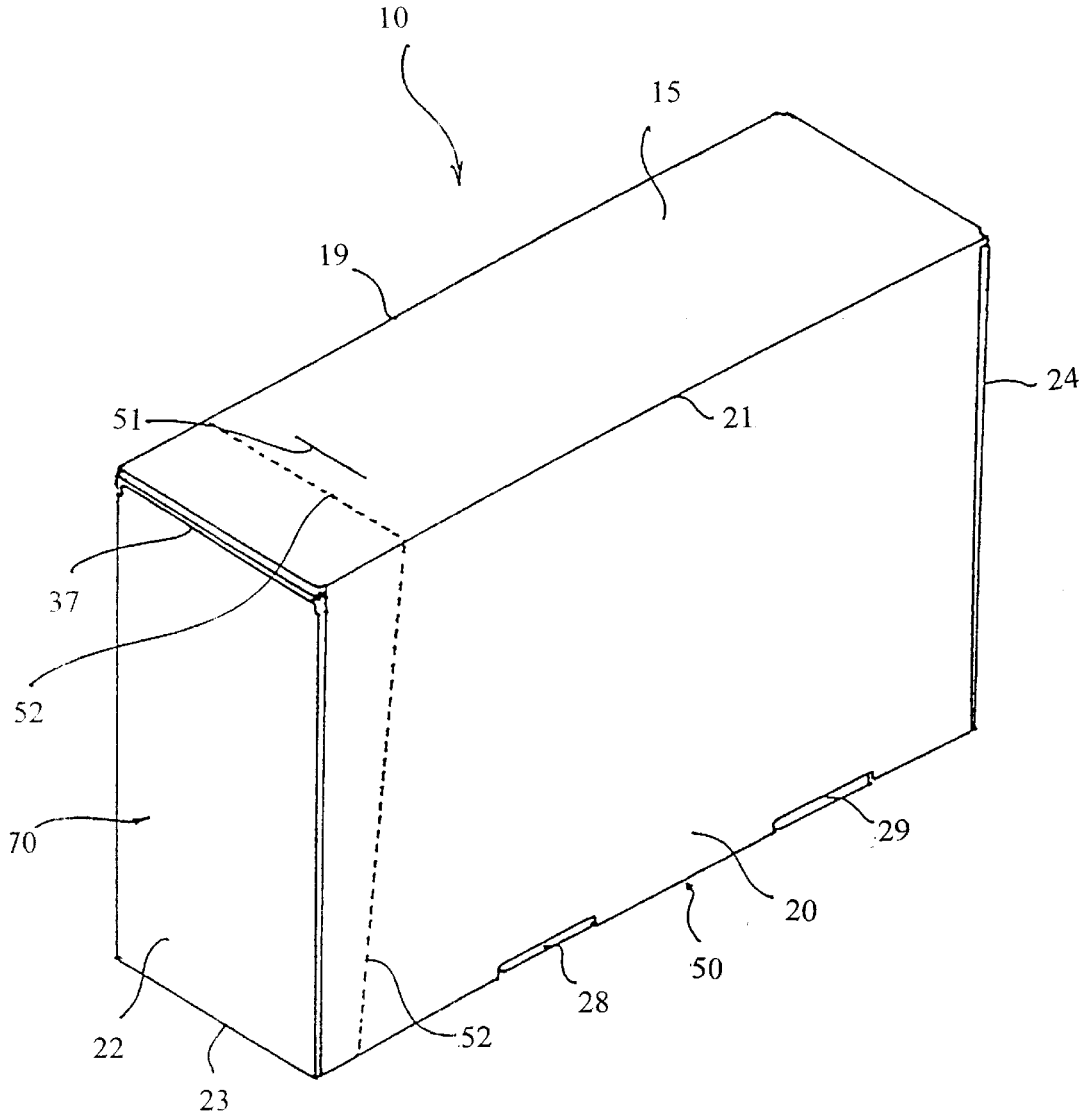
FIG. 1 is a perspective view of a container constructed in accordance with the present invention.
Figure 9:
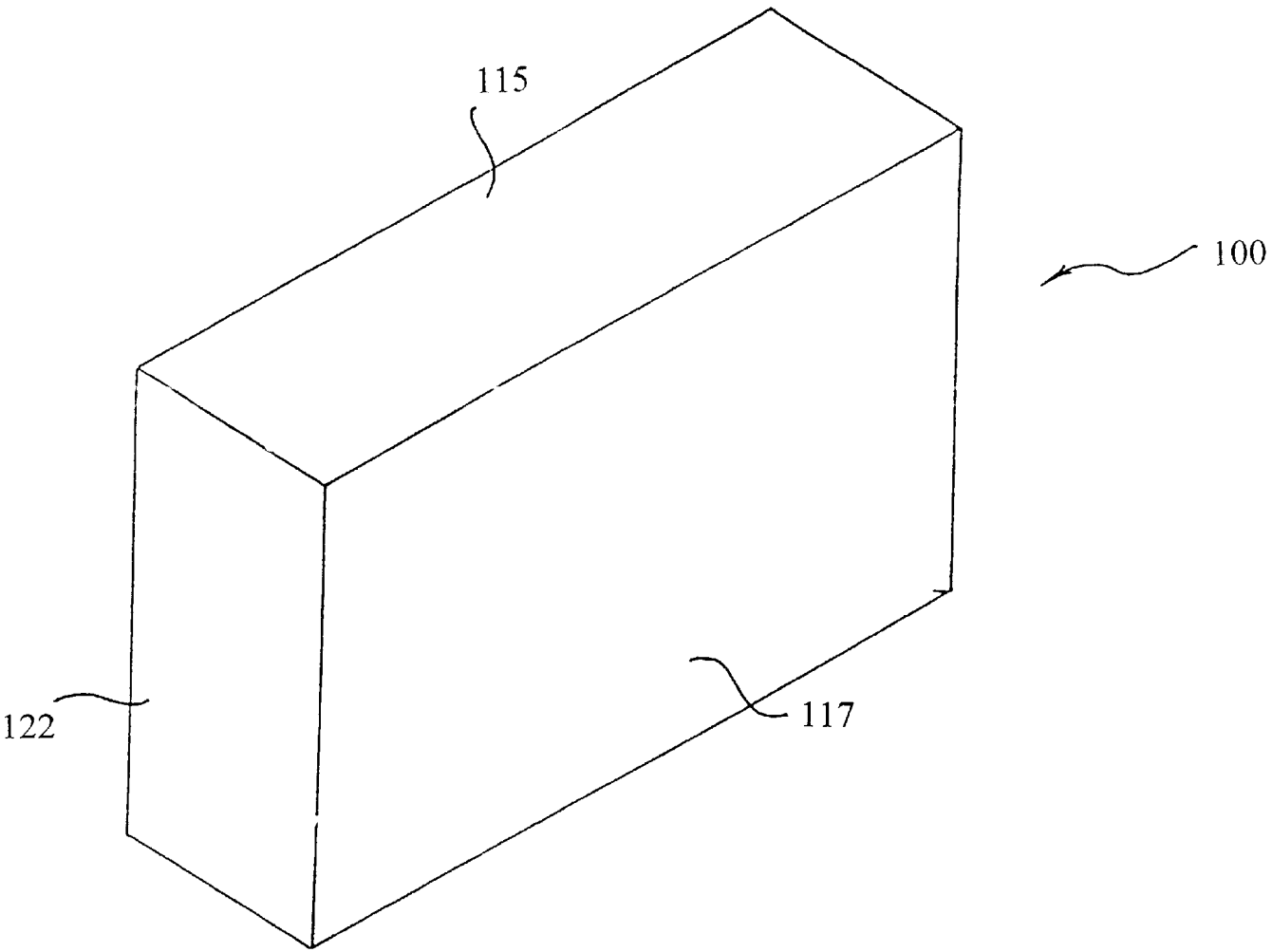
Figure 10:
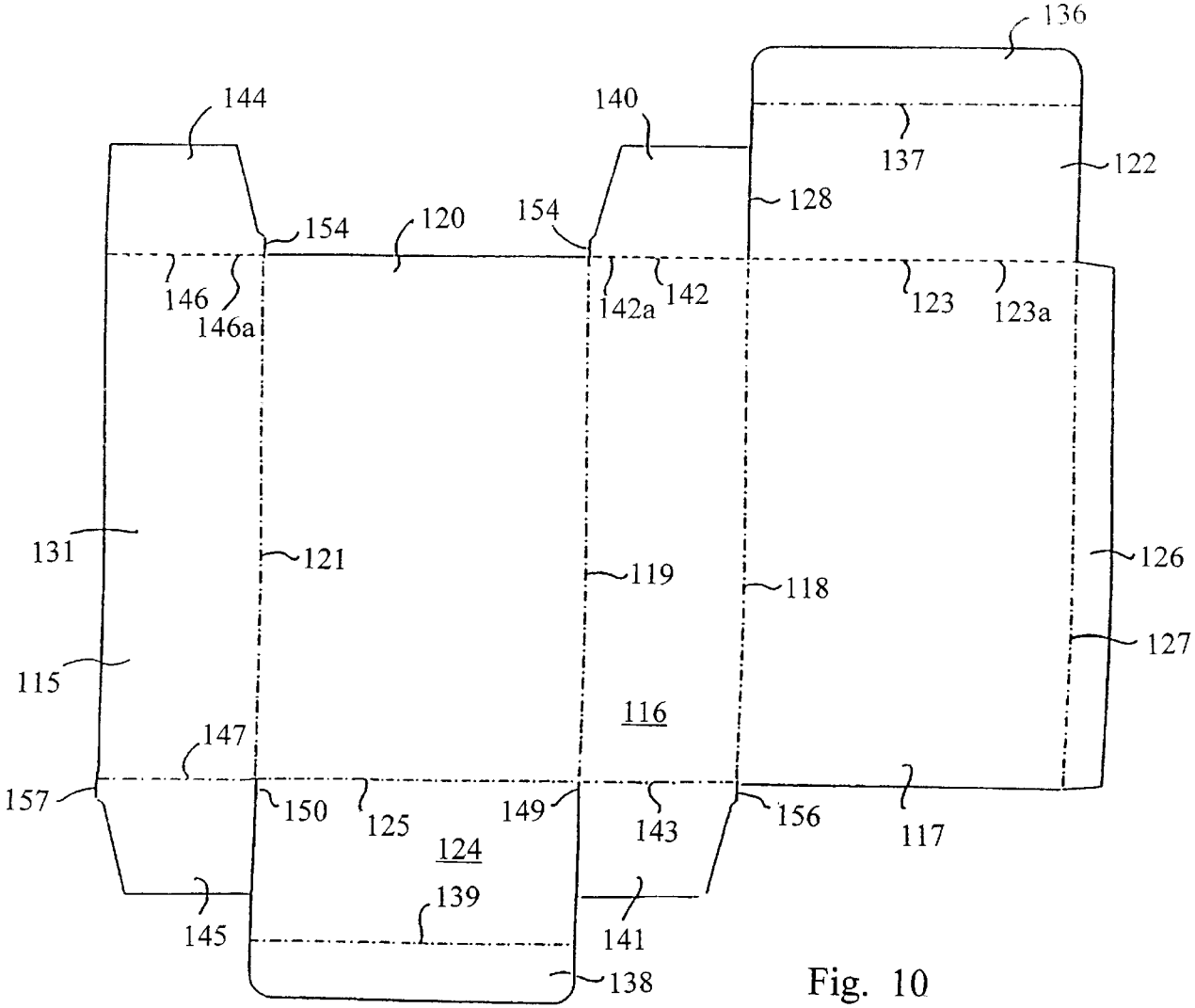
Figure 16:
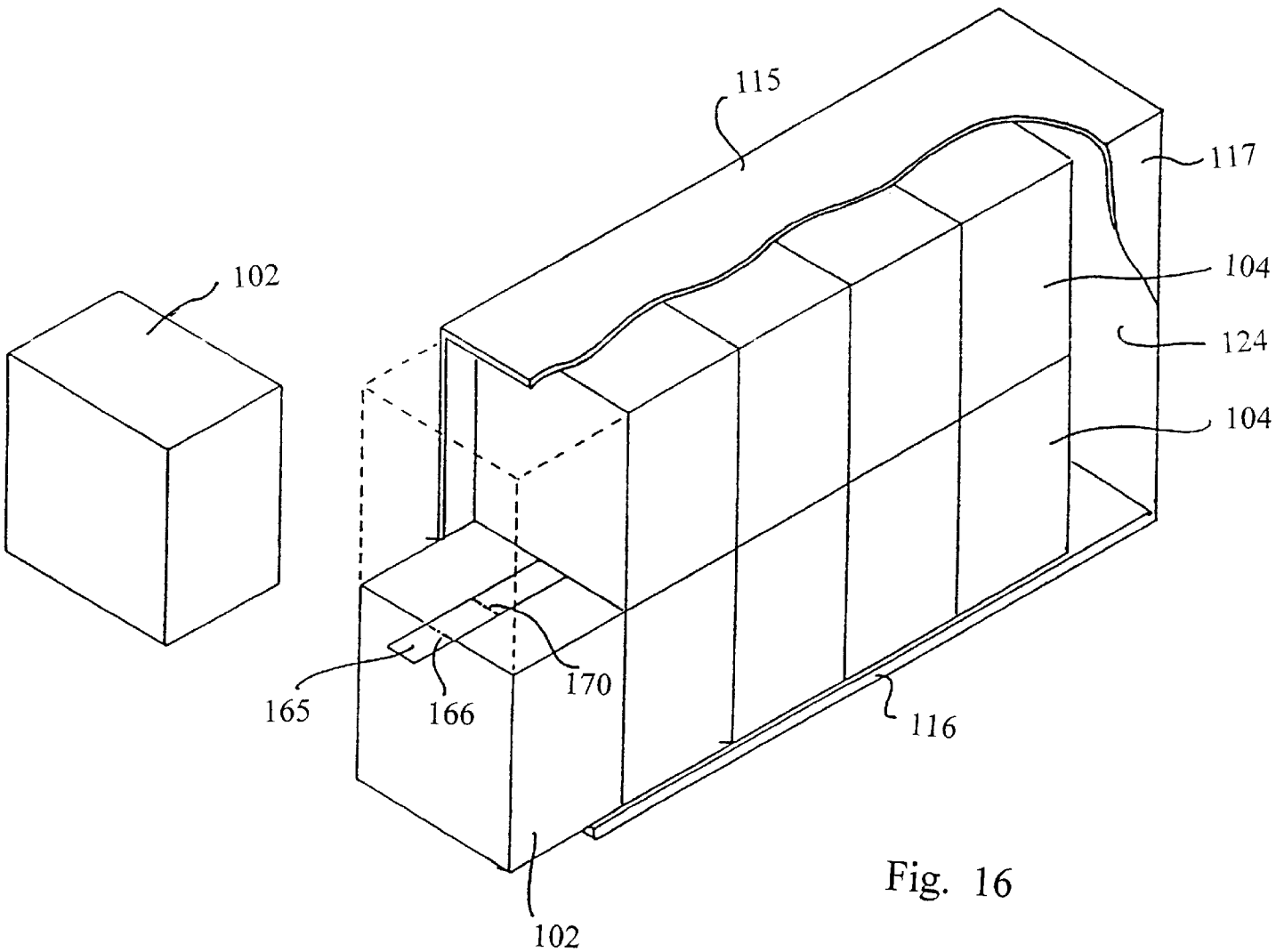
Figure 17:
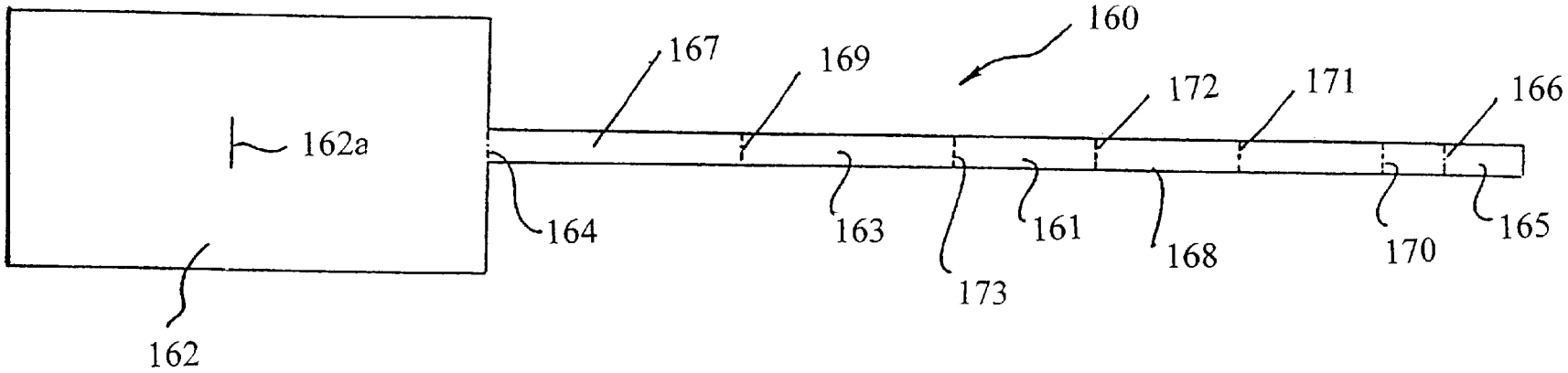
Figure 18:
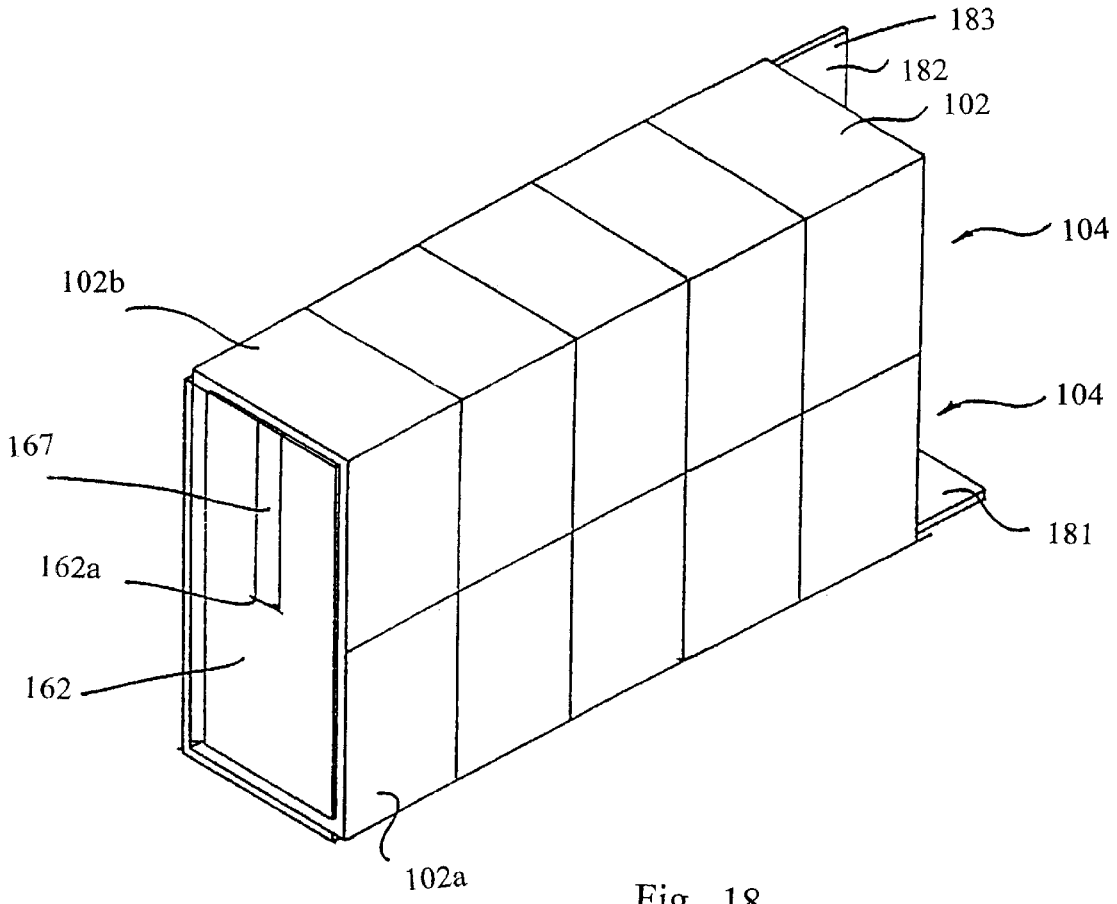
Figure 19:
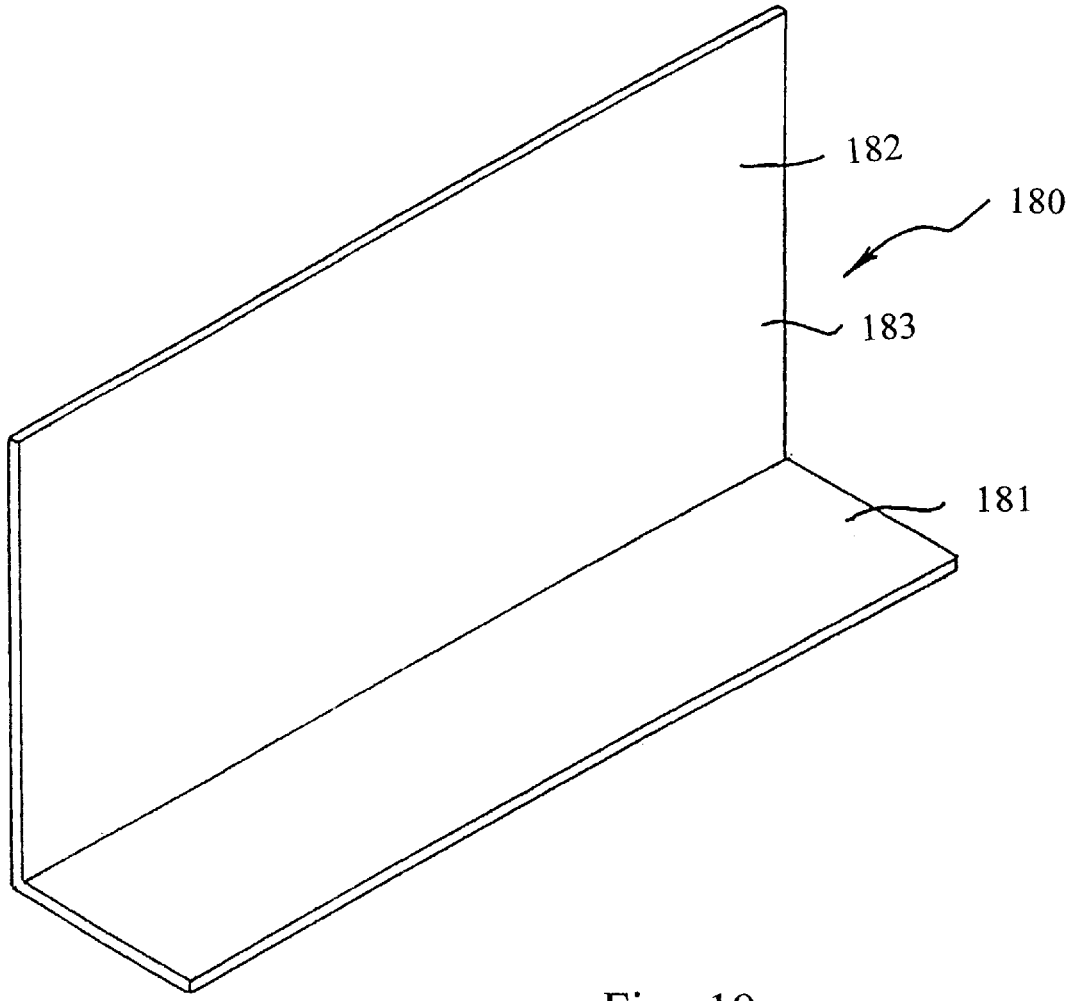

FIGS. 4 to 8 each illustrate a side cross-sectional view of the container illustrated in FIG. 1;

FIG. 9 is a perspective view of a second container constructed in accordance with the present invention;

FIG. 10 is a plan view of the container illustrated In FIG. 9 in blank form;

FIGS. 11 to 15 each comprise a perspective view of the container illustrated in FIG. 9, which is shown in a partially open state;

FIG. 16 is a perspective view of the container illustrated in FIG. 9 with some of the walls cut away so as show the packages stored in the container;

FIG. 17 is a plan view of the promotion means in blank form which may be used in conjunction with the container illustrated in FIG. 9;

FIG. 18 is a perspective view of a plurality of packages arranged on a loading tool prior to their placement in the container illustrated in FIG. 9, and FIG. 19 is a perspective view of the loading tool illustrated in FIG. 18.

FIGS. 1 and 2 and 4 to 8 illustrate a container 10 manufactured from a blank 11 cut from a sheet of paper card.

The container 10 may be used to store and display packaged goods including discrete parcels 12 comprising for example ten individual sachets of tea. Preferably the configuration of the container 10 is such that it may accommodate ten parcels 12 of tea, the parcels 12 being arranged end to end and one on top of the other such that there are two rows 14 each comprising five parcels 12 of tea.

Figure 2:
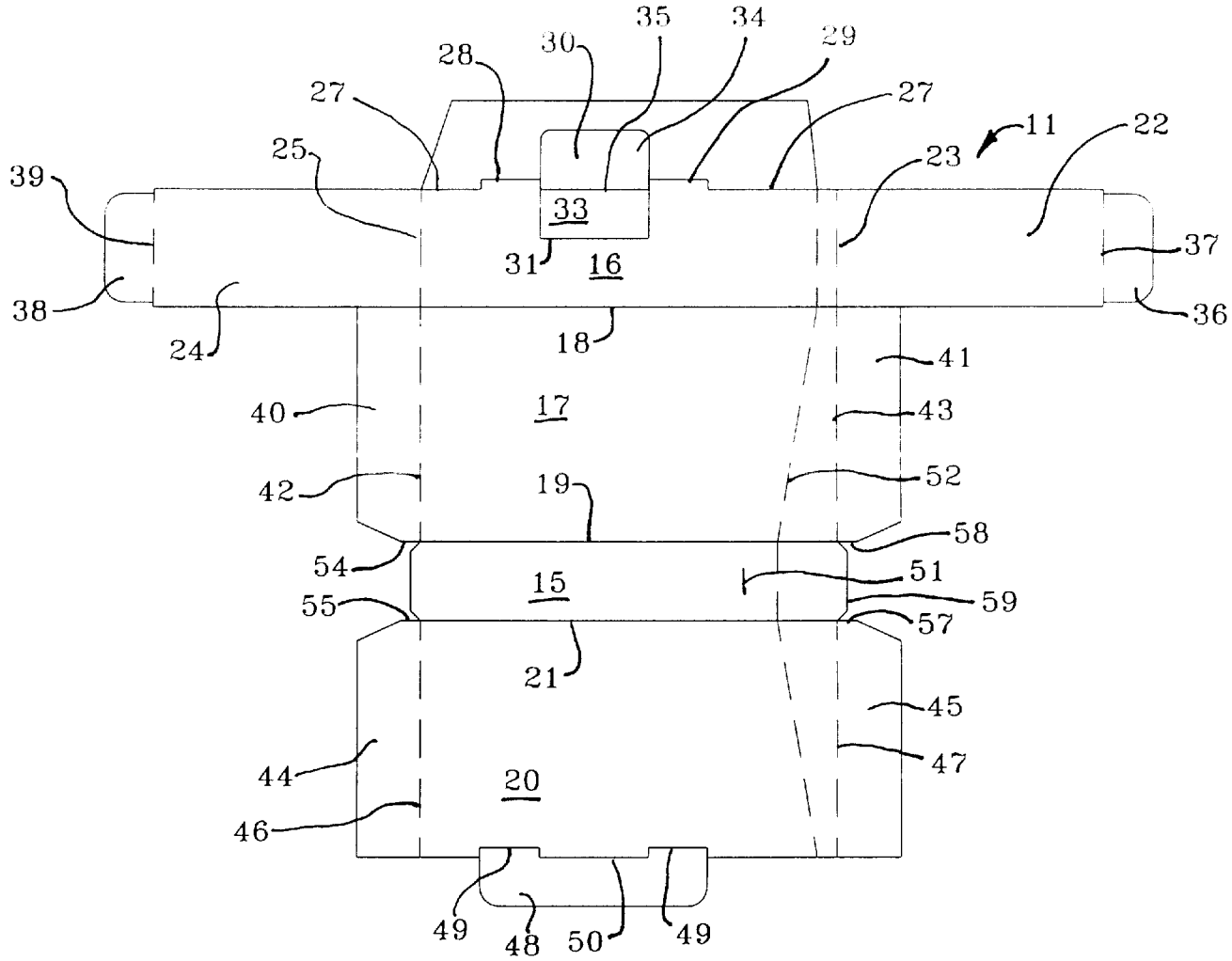
FIG. 2 is a plan view of the container illustrated in FIG. 1 in blank form.

The container 10 may be seen in blank form by reference to FIG. 2. The container includes a bottom wall 16 connected to a left side wall 17 along a told line 18. A top wall 15 is connected to the left side wall 17 along a fold line 19, and at its opposite side is connected to a right side wall 20 along fold line 21. The bottom wall 16 is also connected to a front wall 22 along a fold line 23, and at its opposite end,to a rear wall 24 along a fold line 25.

The bottom wall 16 also includes a major flap 26 which is connected thereto along fold line 27 and which is separated from the bottom wall 16 by two outs 28 and 29.

A connecting flap 30, connected to the bottom wall 16 along fold line 31 and formed by cut line 32, includes an intermediate portion 33 and an and portion 34, said intermediate portion being connected to the end portion along fold line 35.

The front wall 22 includes a connecting flap 36 connected to the free and of the front wall 22 along fold line 37. Similarly, the rear wall 24 includes a connecting flap 38 connected to the free end of the rear wall 24 along fold line 39.

The left side wall 17 includes two opposing major flaps 40 and 41 connected to said side wall along respective fold lines 42 and 43.

The top wall includes a small cut line 51 formed therein and which is substantially parallel to an edge thereof.

The right side wall 20 includes two opposing major flaps 44 and 45 connected to said side wall along respective fold lines 46 and 47. The right side wall 20 also includes a connecting flap 48, connected to the right side wall 20 along fold line 49 and formed by cut line 50.

The blank also includes a perforated line 52 which transgresses the bottom wall 16, the left side wall 17, the top wall 15 and the right side wall 20.

To form the container 10, the side walls 17 and 20 are folded such that they depend from the top wall 15 and are contained in respective parallel planes. The major flap 26 in turn is folded upwardly such that it abuts against the internal surface of the right side wall 20 and is retained in place by the insertion of the major flap 48 in the slit formed by cut lines 28 and 29. to further prevent the outward splaying of the side walls 17 and 20, the end portion 34 of the connecting tab 30 is inserted in the slot formed by cut line 50.

The major flaps 40 and 44 may then be folded inwardly so as to substantially close the rearward opening defined by the side edges of the bottom wall 16, left side wall 17, top wall 15 and right side wall 20. Having done so, the rear wall 24 may be folded upwardly and secured in a closing attitude by the insertion of the connecting tab 38 into the gaps between the upper edge portions 54 and 55 of the tabs 40 and 44 respectively and the rear upper edge 56 of the top wall 15.

The major flaps 41 and 45 in turn may also be folded inwardly so as to substantially close the forward opening defined by the side edges of the bottom wall 16, left side wall 17, top wall 15 and right side wall 20. Having done so, the front wall 22 may be folded upwardly and secured in a closing attitude by the insertion of the connecting tab 36 into the gaps between the upper edge portions 58 and 57 of the tabs 41 and 47 respectively and the forward upper edge 59 of the top wall 15.

Figure 3:
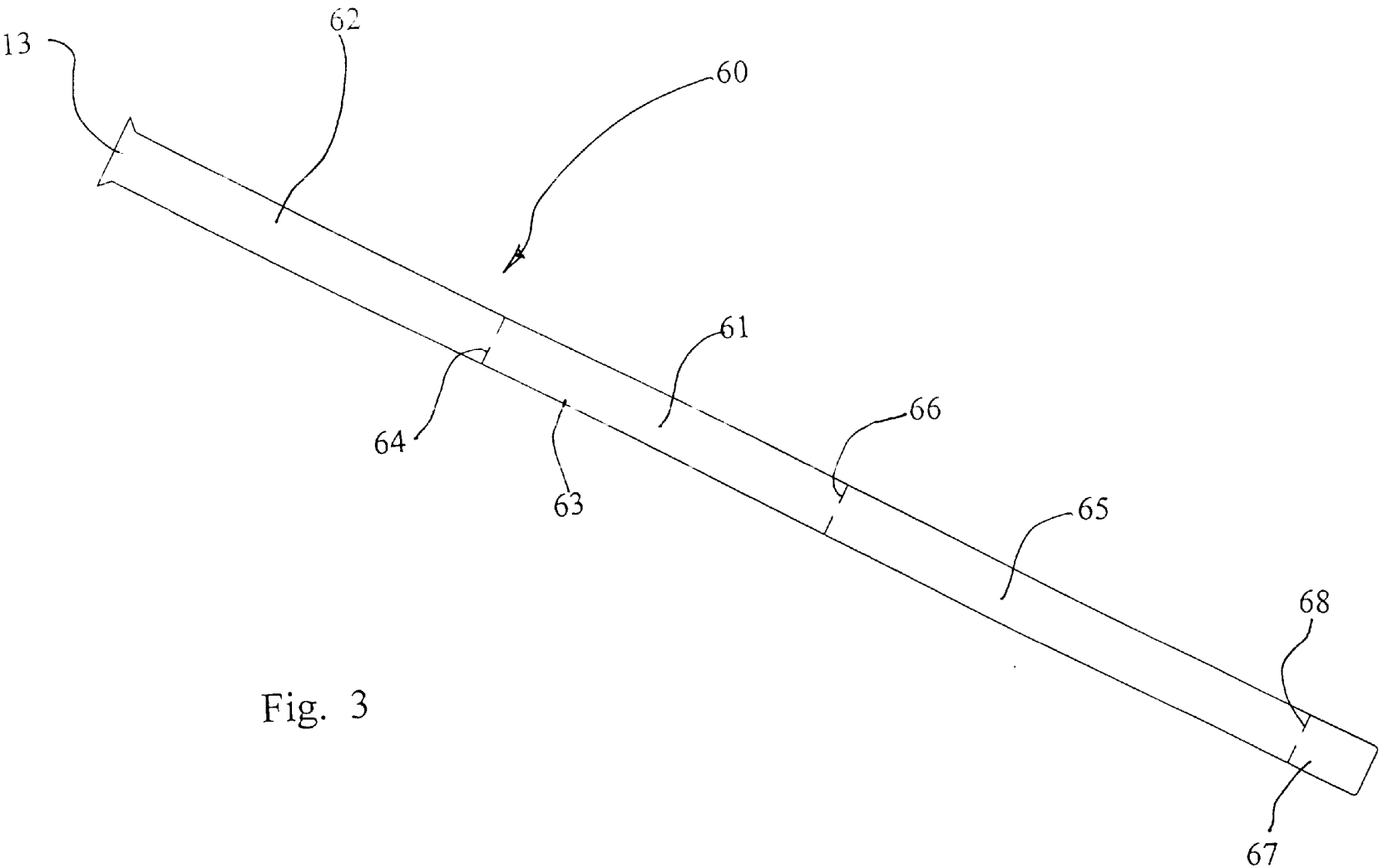
FIG. 3 is a plan view promotion means constructed in accordance with container.

Preferably the container 10 also includes promotion means 60 such as the elongate member 61 manufactured from paper card and show in blank form in FIG. 3 The elongate member 61 includes a first or rear portion 62 which is connected to a second or intermediate portion 63 along a fold line 64, The rear portion 62 includes an enlarged rear mounting portion 13 which is larger than the slit in the top wall 15 provided by cut line 51.

The intermediate portion 63 is connected to a third or forward portion 65 along a fold line 66. The forward portion includes an end portion or tab 67 connected to the forward portion 65 along a fold line 68.

In use, containers 10 may be placed on the shelves such as retail outlets and thereinafter used both to store and display/dispense parcels 12 containing ten sachets of tea each.

Preferably the foremost container 10 is displayed in an open state, i.e. the front wall 22 has been folded forwardly and downwardly and the major flaps 41 and 45 have been folded outwardly so as to expose and thereby provide access to the foremost parcels 12*a* and 12*b*. In order to assist consumers to grip the foremost parcels 12*a* and 12*b* the forward portion 70 of the container 10 may be removed by cutting along the perforated 52.

Figure 4:
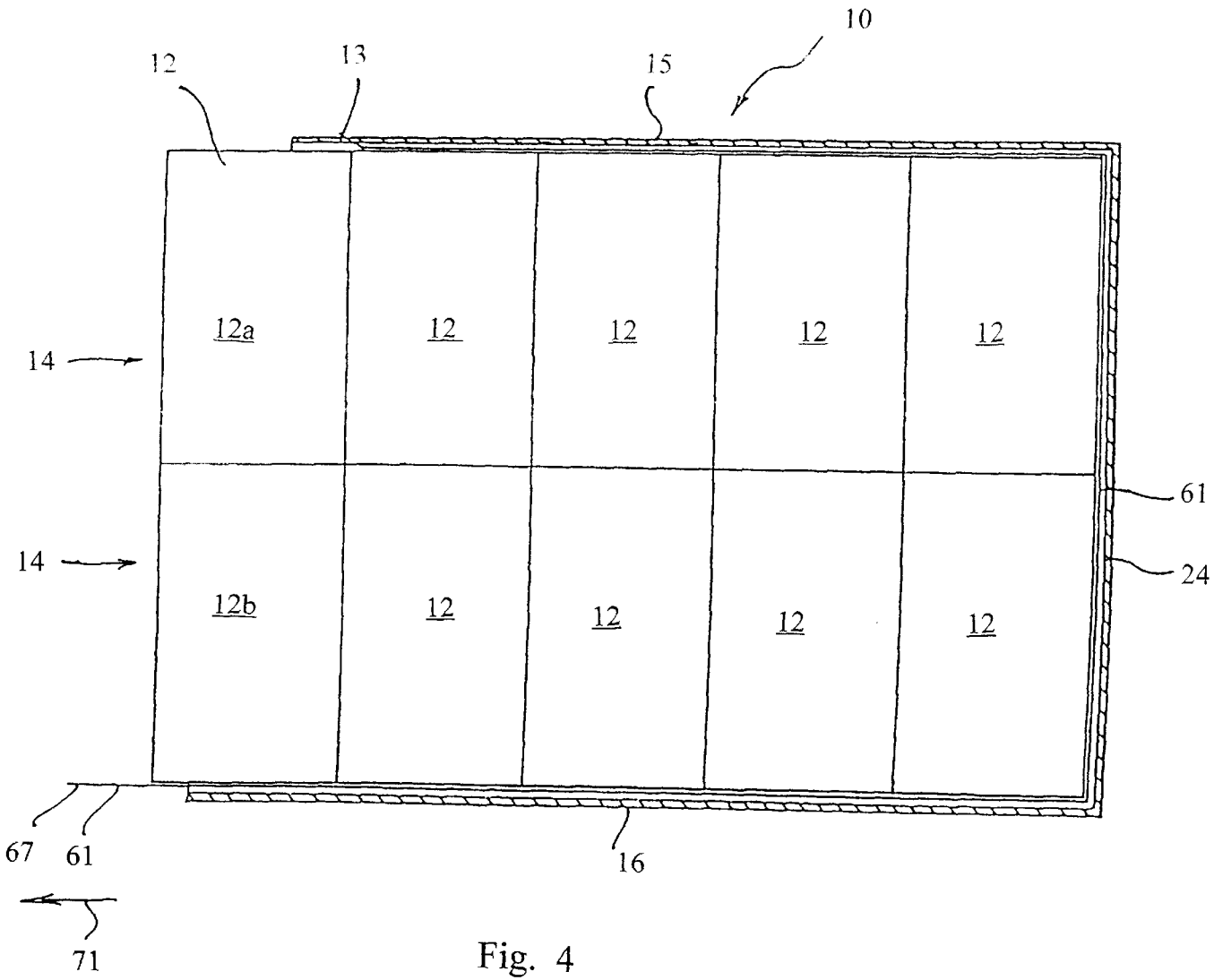

The tab 67 protrudes outwardly from the underside of parcel 12*b* as illustrated in FIG. 4.

Figure 5:
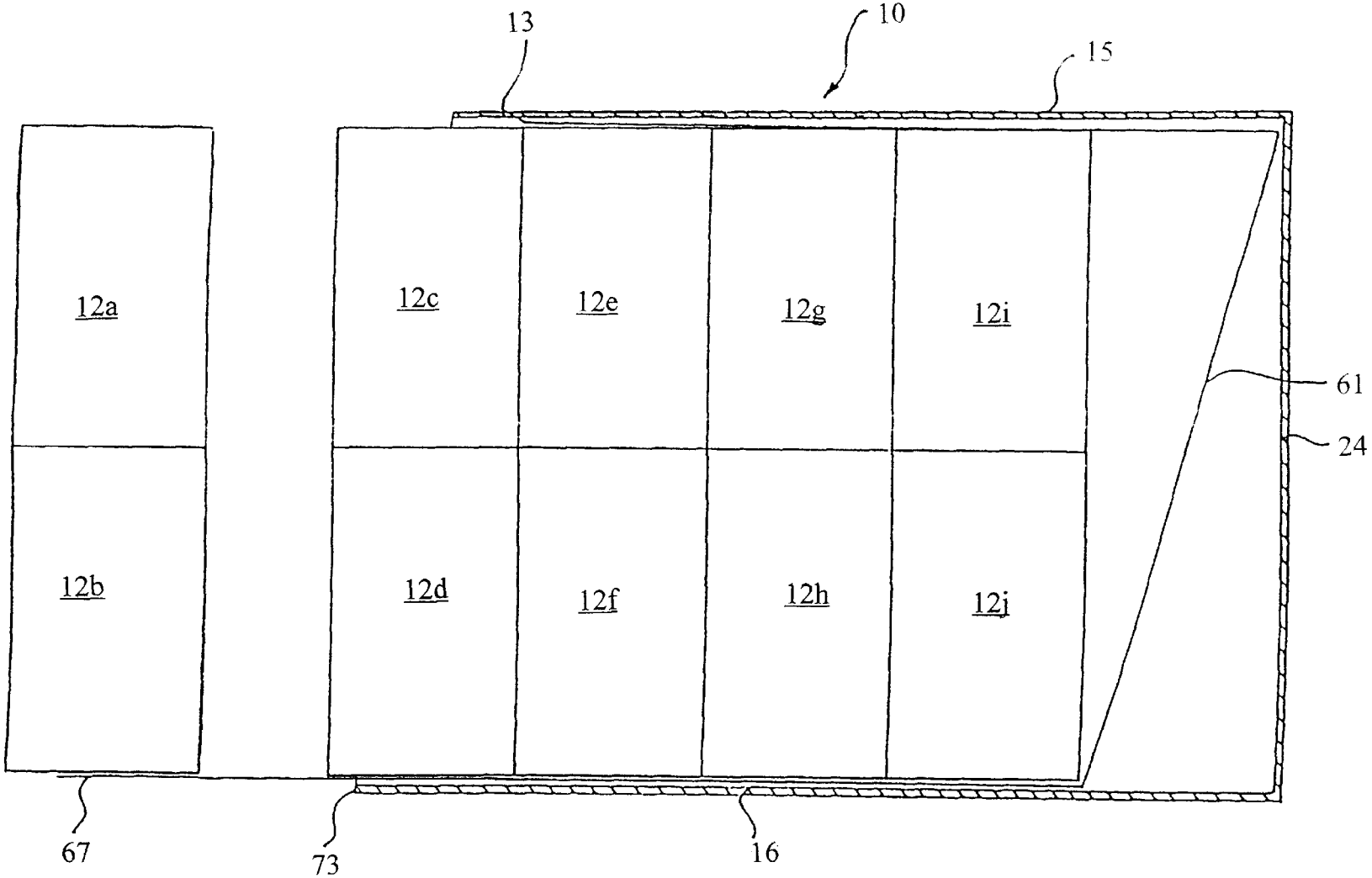

The void caused by the removal of the foremost parcels 12*a* and 12*b* may be filled by the consumer pulling the tab 67 in a generally forward direction as indicated by arrow 71 a distance sufficient to advance parcels 12*c* and 12*d* beyond the lower lip 73 of the container 10 as illustrated in FIG. 5. In addition it will be appreciated from a review of FIG. 5 that the upper rearmost corner of the parcel 12*i* is engaged with a portion of the rear portion 62 of the elongate member 61 and that the lower rearmost corner of the parcel 12*j* engages the fold line 66 or a portion of the intermediate portion 63 adjacent said fold line.

Figure 6:
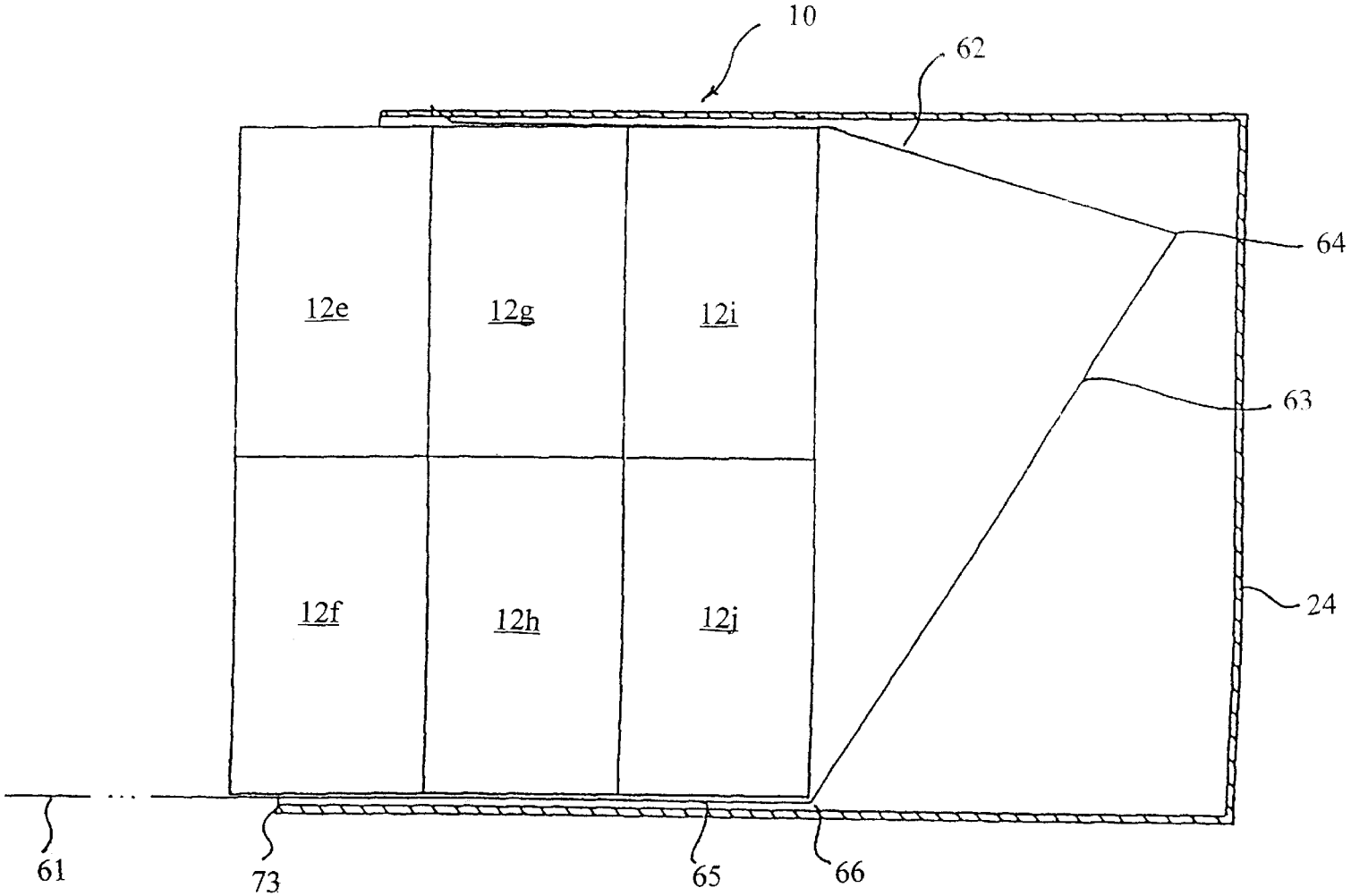

In turn the void caused by the removal of the foremost parcels 12*c* and 12*d* may be filled by the consumer pulling the tab 67 in a generally forward direction as indicated by arrow 71 a further distance sufficient to advance parcels 12*e* and 12*f* beyond the lower lip 73 of the container 10 as illustrated in FIG. 6. In order to avoid the unsightly appearance caused by the foremost portions of the elongate member 61 dangling down from the shelf on which the container rests a proportion of the exposed elongate member way be detached and disposed of.

Figure 7:
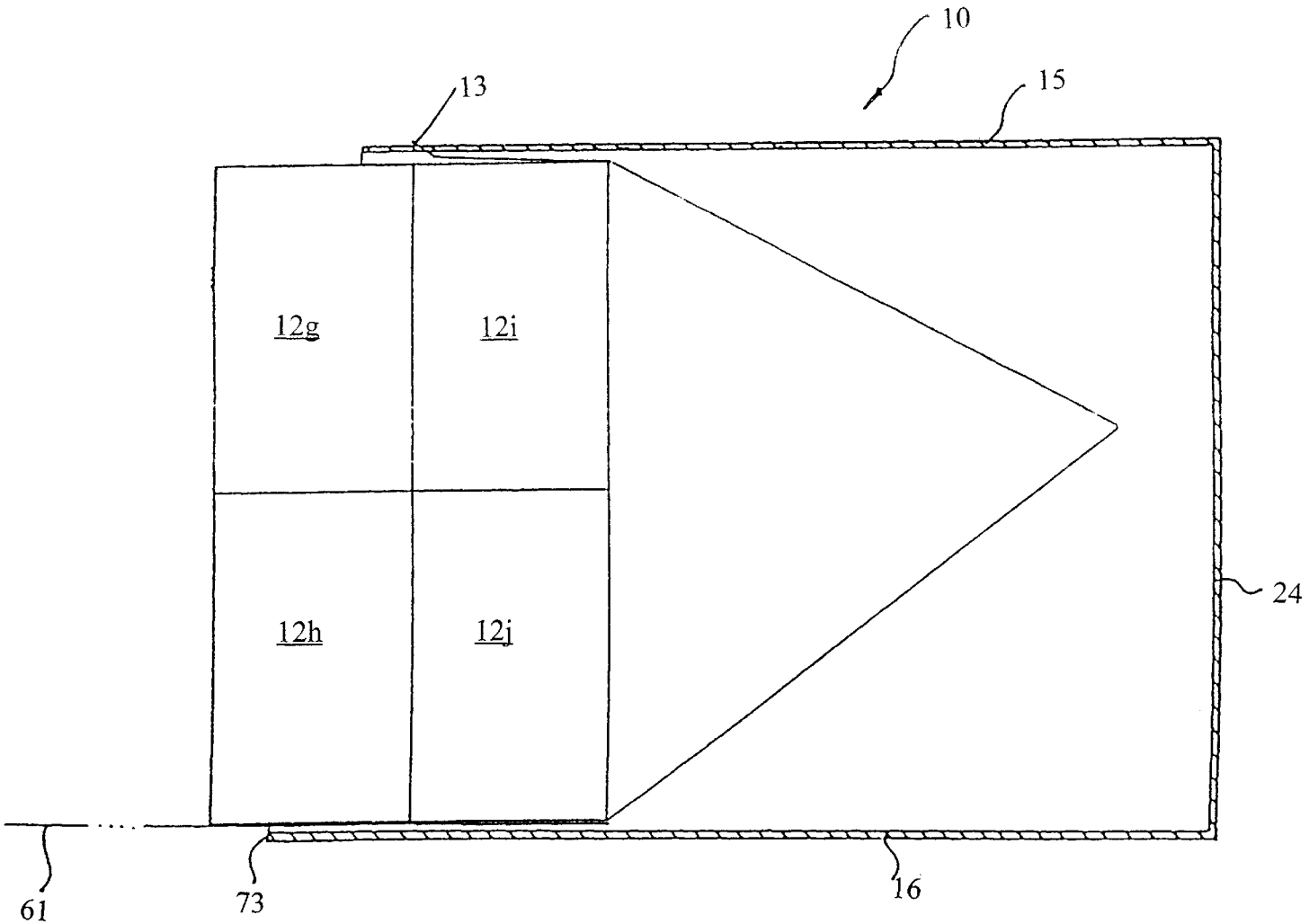

The void caused by the subsequent removal of the foremost parcels 12*e* and 12*f* may be filled by the consumer pulling the exposed or leading portion of the elongate member 61 in a generally forward direction as indicated by arrow 71 a distance sufficient to advance parcels 12*g* and 12*h* beyond the lower lip 73 of the container 10 as illustrated In FIG. 7.

Figure 8:
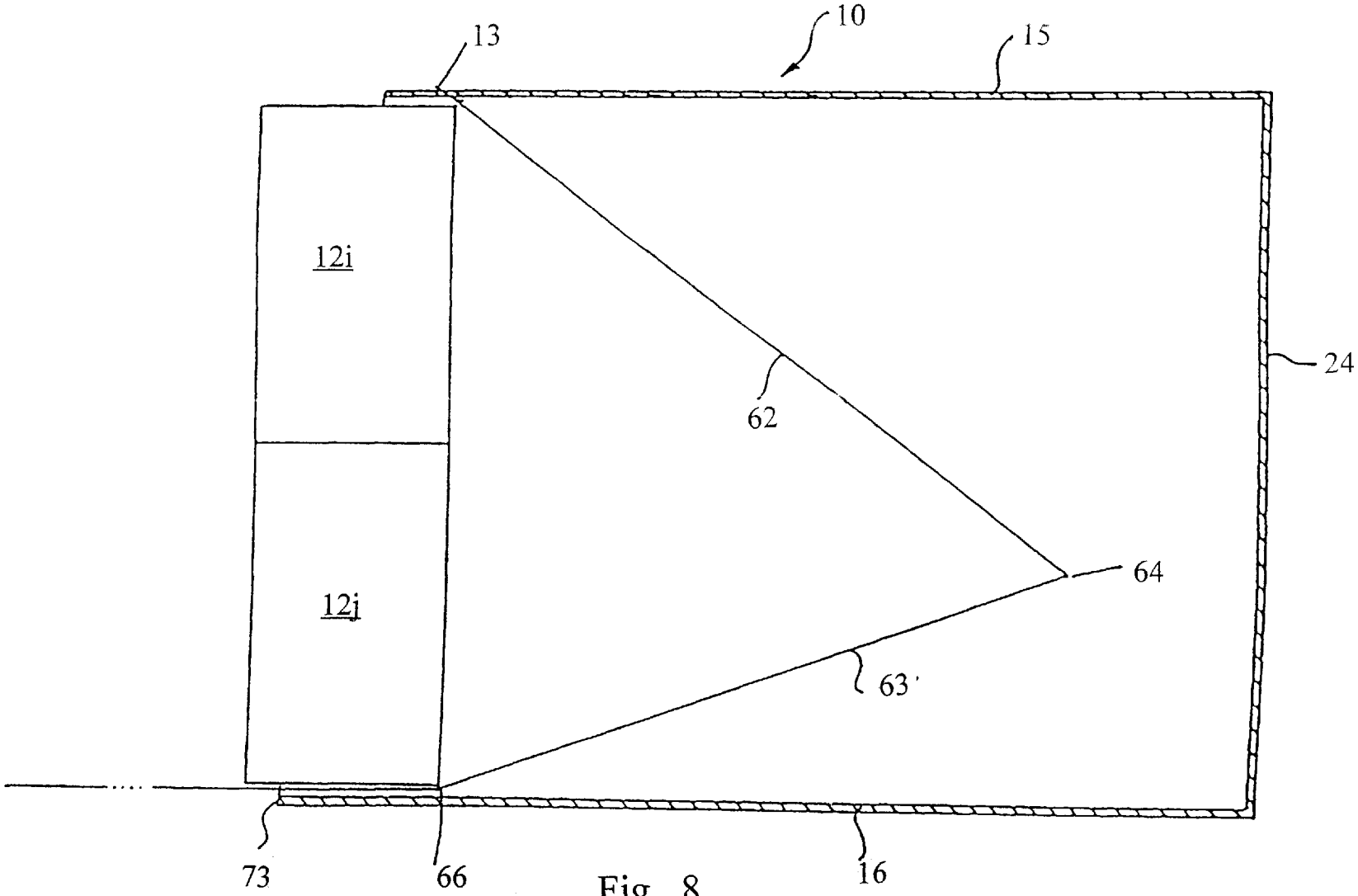

In turn the void caused by the removal of the foremost parcels 12*g* and 12*h* may be filled by the consumer pulling the remainder of the elongate member 61 extending outwardly from the container 10 in a generally forward direction as indicated by arrow 71 a distance sufficient to advance parcels 12*i* and 12*j* beyond the lower lip 73 of the container 10 as illustrated in FIG. 8.

FIGS. 9 to 16 illustrate a second container 100 manufactured from a blank 101 cut from a sheet of paper card.

The container 100 may be used to store and display packaged goods including discrete parcels 102 comprising for example ten individual sachets of tea. Preferably the configuration of the container 100 is such that it may accommodate ten parcels 102 of tea. The parcels 102 are preferably arranged end to end and one on top of the other such that there are two rows 104 each comprising five parcels 102 of tea as illustrated in FIG. 16.

The container 100 includes a top wall 115, a bottom wall 116, two opposing side walls hereinafter referred to as the right and left side walls 117 and 120 respectively, and two opposing end walls hereinafter referred to as the front and rear walls 122 and 124 respectively.

The container 100 may be seen in blink form by reference to FIG. 10. The bottom wall 116 is connected to the left side wall 117 along a fold line 118 and to the right side wall 120 along an opposing fold line 119. The right side wall 120 is connected to the top wall 105 along a fold line 121. The left side wall 117 is also connected to the front wall 122 along a fold line 123 which is punctuated by a series of perforations 123*a*. The right side wall 120 is also connected to the rear wall 124 along a fold line 125.

The left side wall 117 includes a rectangularly shaped major flap 126 which is connected thereto along fold line 127.

The front wall 122 includes a connecting flap 136 connected to the free end of the front wall 122 along fold line 137. Similarly, the rear wall 124 includes a connecting flap 138 connected to the free end of the rear wall 124 along gold line 139, The bottom wall 116 includes two opposing major flaps 140 and 141 connected to said bottom wall along respective fold lines 142 and 143. In addition the fold line 142 is punctuated by a series of perforations 142*a*. The major flap 140 is separated from the adjacent front wall 122 by a cut line 128. The major flap 143 is separated from the adjacent rear wall 124 by a cut line 149.

The top wall 115 includes two opposing major flaps 144 and 145 connected to said top wall along respective fold lines 146 and 147. The major flap 145 is separated from the adjacent rear wall 124 by a cut line l50. In addition the fold line 146 is punctuated by a series of perforations 146*a*.

To form the container 100, the side walls 117 and 120 are folded along fold lines 118 and 119 respectively such that they extend upwardly at right angles to the bottom wall 116 and are contained in respective parallel planes The major flap 126 is folded along told line 127 such that it lies in a plane substantially parallel to the plane containing the bottom wall 116 and points In the general direction of the right side wall 120.

The top wall 115 in turn Is folded along fold line 121 such that it lies in a plane which is substantially parallel to the plane containing the bottom wall 116 and the free edge portion 131 of said top wall overlies the major flap 126. A suitable adhesive may be subsequently used to secure the underside of the edge portion 131 to the top surface of the flap 126.

The major flaps 140 and 144 may then be folded inwardly along respective fold lines 142 and 146 so as to substantially close the forward opening defined by the side edges of the bottom wall 116, left sided wall 117, top wall 115 and right side wall 120 Having done so, the front wall 122 may be folded along fold line 123 such that said wall when in a closed position overlies the major flaps 140 and 144 as illustrated in FIG. 9. The front wall 122 is retained in a closed position by the insertion of the inwardly directed connecting flap 136, which has been previously folded along fold line 137, between the edge portions 154 and 155 of the major flaps and the adjacent side wall 120.

The major flaps 141 and 145 in turn may also be folded inwardly along respective fold lines 143 and 147 so as to substantially close the rearward opening defined by the side edges of the bottom wall 116, left side wall 117, top wall 115 and right side wall 120. Having done so, the rear wall 124 way be folded along fold line 125 such that said wall when in a closed position overlies the major flaps 141 and 145. The rear wall 124 is retained in a closed position by the insertion of the inwardly directed connecting flap 138, which has been previously folded along fold line 139, between the edge portions 156 and 157 of the major flaps and the adjacent side wall 117.

Preferably the container 100 also includes promotion means 160 such as the elongate member 161 manufactured from paper card and shown in blank form in FIG. 17. The elongate member 161 includes an enlarged rear portion 162 which is substantially rectangular in shape and which includes a centrally located slit 162*a* formed therein.

The rear portion 162 is connected to a second or intermediate portion 163 along a fold line 164 The intermediate portion includes a first portion 167 and a second portion 168 separated by a fold line 169. The second portion 168 is divided into five discrete portions by perforated lines 170, 171, 172 and 173.

The intermediate portion 163 is connected to a third or forward end portion 165 along a fold line 166.

The promotion means is assembled by first folding the intermediate portion 163 along the fold line 164 such that the first portion 167 overlies the enlarged rear portion 162. In doing so, the forward end portion 165 is inserted through the slit 162*a* and wherein the intermediate portion 163 extends outwardly from the rear portion 162 generally at right angles to said rear portion about fold line 169.

Preferably a loading tool 180 of the type illustrated in FIG. 19 is used to load ten parcels into the container 100. The loading tool 180 includes a bass wall 181 and an upstanding side wall 182.

The loading tool may be made from a rigid material such as a metal, wood or plastics material.

Preferably the width of the loading tool allows the tool to be inserted into a contains 100. It is also preferred that the loading tool is longer than the depth of the box such that an end portion 183 of the tool 180 may be used as a handle.

Figure 14:
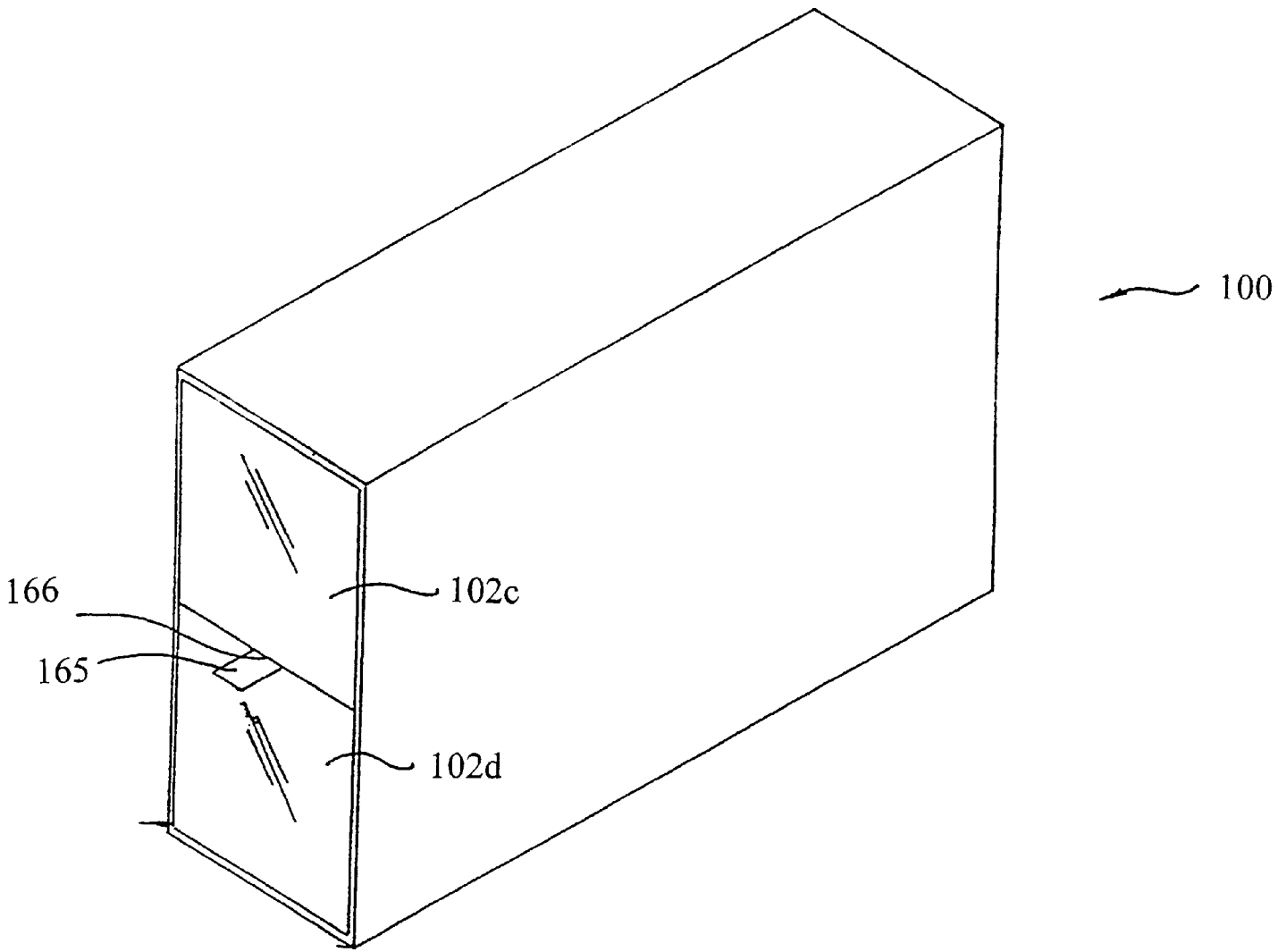

When loading the loading tool, five parcels 102 are arranged end to end on the bottom wall 181 such that the parcels also bear against the side wall 182, as illustrated in FIG. 18. The promotion means in turn is located intermediate the lower row of parcels 102 and an upper row of parcels subsequently placed on top thereof such that the enlarged rear portion 162 bears against the two rearmost parcels 102*a* and 102*b* and the intermediate portion 163 extends between said upper and lower rows, as shown in FIG. 18. It is also noted that the end portion 165 of the promotion means 160 is permitted to extend beyond the front faces of the two foremost parcels 102*c* and 102*d* as illustrated in FIG. 14.

The loading tool and the ten parcels are then inserted, rear first, into the container 100 and wherein, having located the parcels 102 in the container 100, the loading tool may be withdrawn.

Furthermore, while the loading process described herein is a manual process, it will be appreciated that a similar automated process may be used to load the parcels into the container.

In use, the containers 100 may be placed on the shelves of retail outlets or the like and thereinafter used both to store and display/dispense parcels 102 containing ten sachets of tea each.

Figure 11:
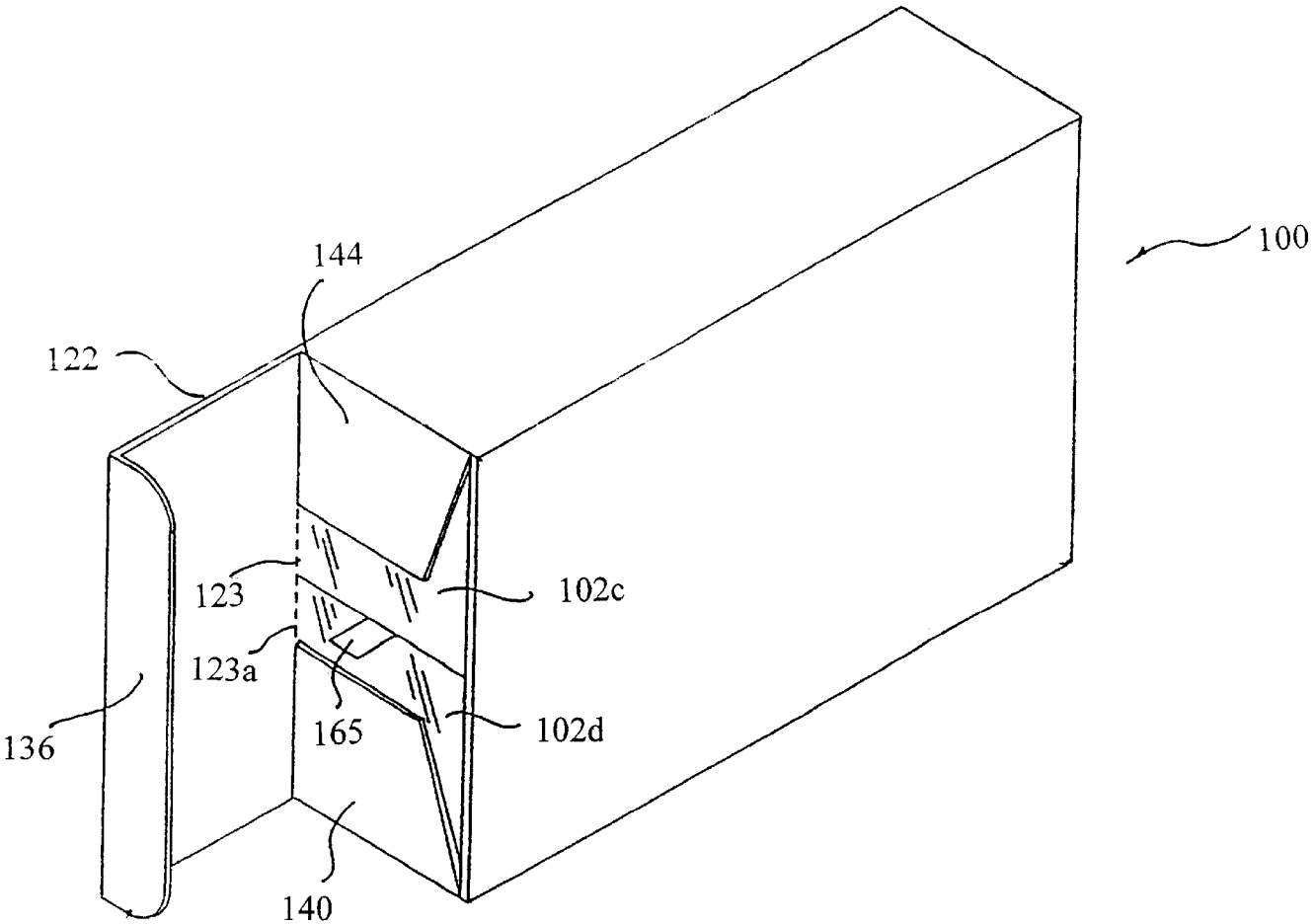
Figure 12:
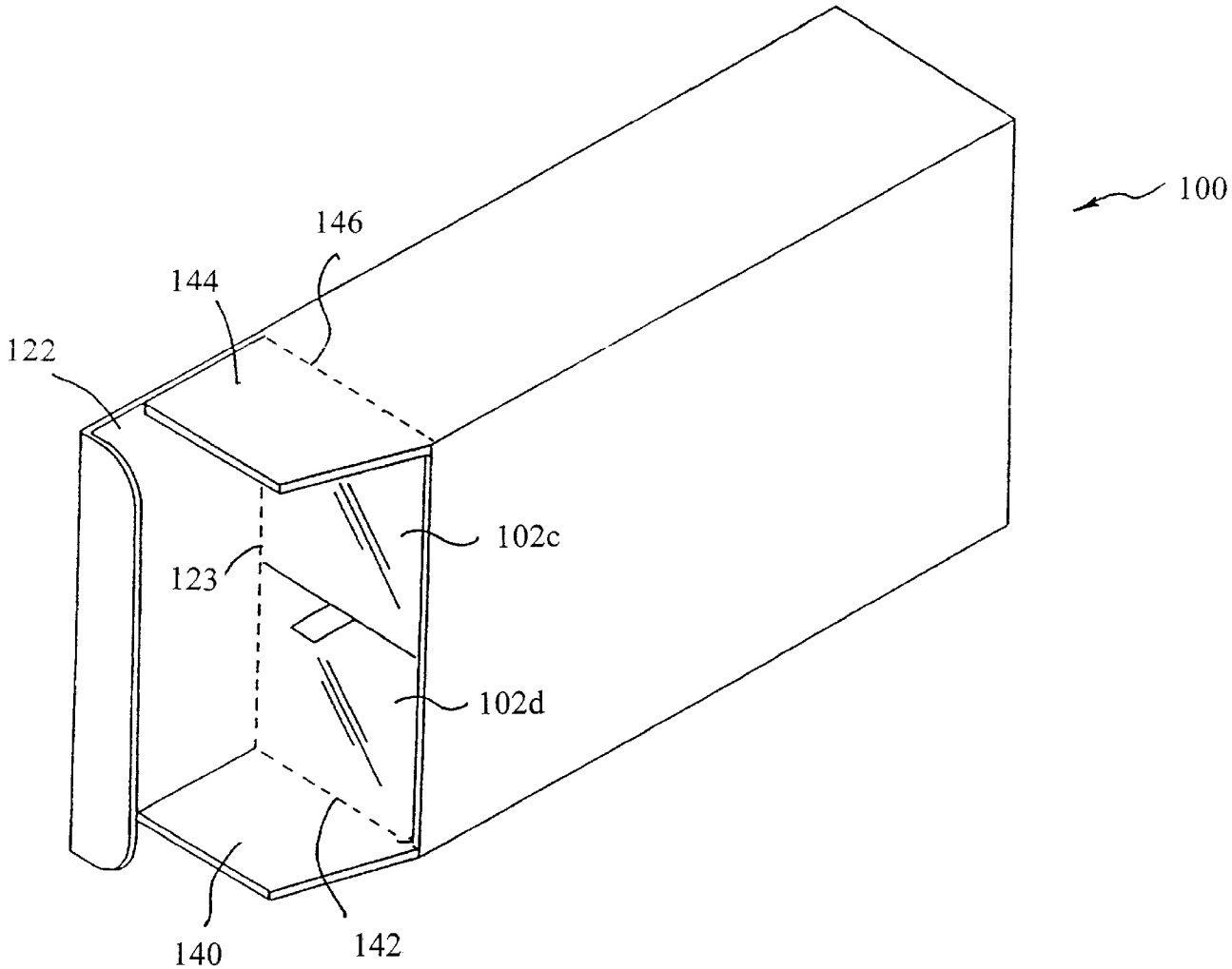
Figure 13:
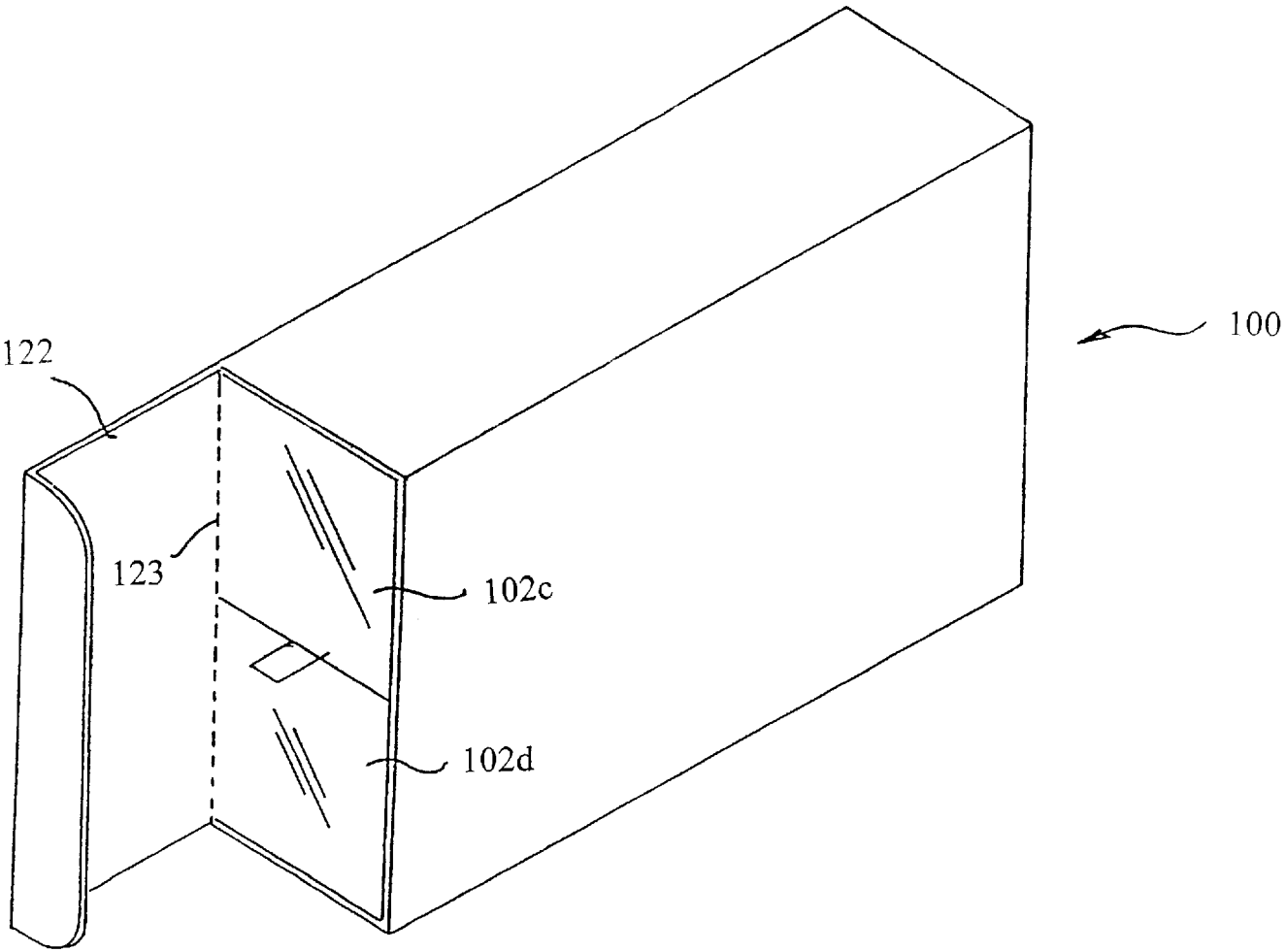

Preferably the foremost container 100 is displayed in an open state, i.e. The front wall 122 and the major flaps 140 and 144 have been folded back so as to reveal the foremost parcels 102*c* and 102*d* as illustrated in FIG. 11. The front wall 122 and the major flaps 140 and 144 may be separated from the container 100 by tearing along the perforated fold lines 123, 142 and 146 respectively, as illustrated in FIGS. 12 to 14.

Figure 15:
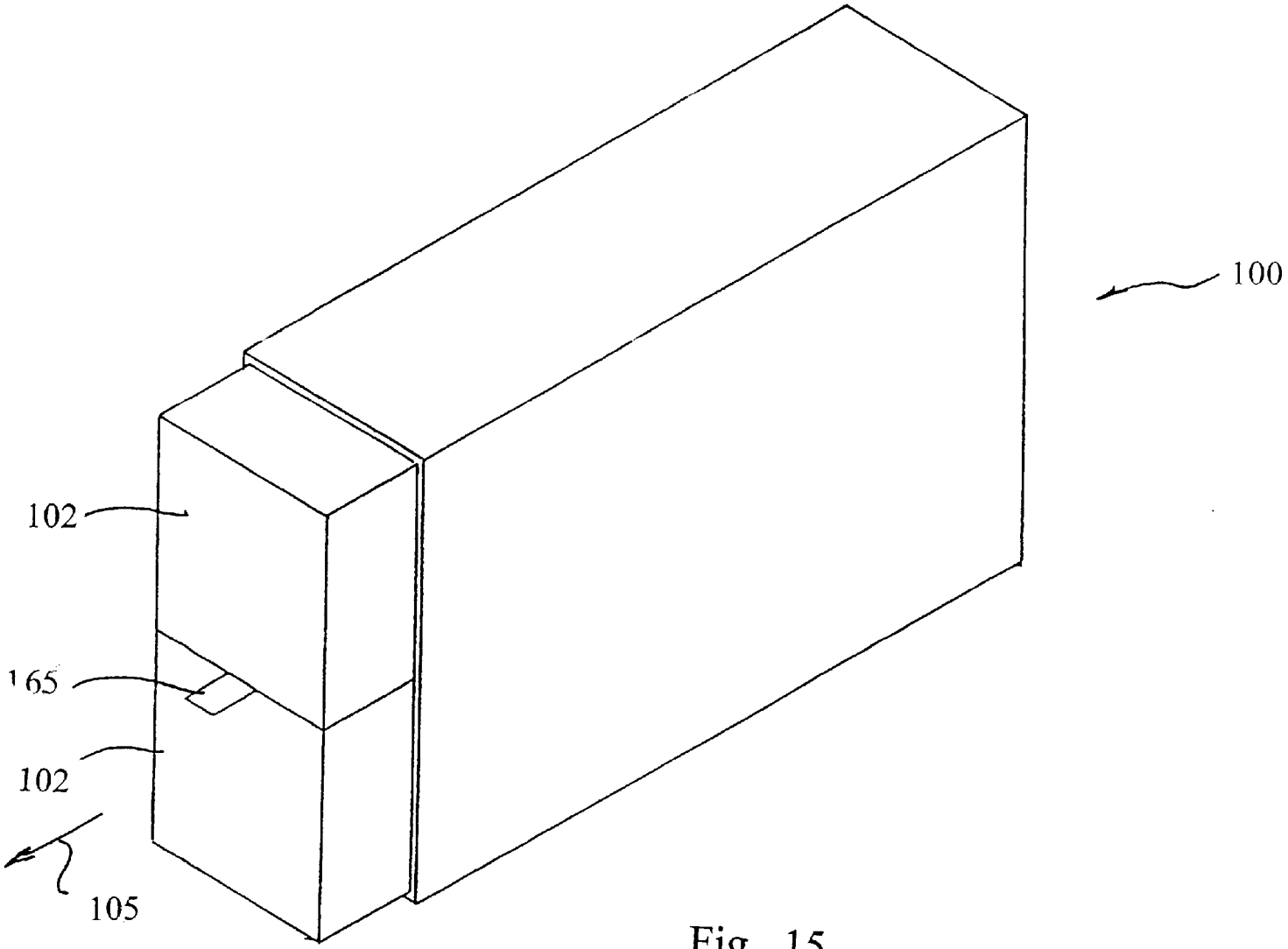

The parcels 102 may be dispensed by pulling the end portion 165 of the promotion means 160 in the direction of arrow 105. However it is preferred that the promotion means is used to advance two parcels at a time as illustrated in FIGS. 15 and 16.

Furthermore, in order to avoid having an unsightly strip of paper card hanging down from the container 100, the intermediate portion 163 may be trimmed by tearing along the various perforated lines 170, 171, 172 and 173 as they are progressively exposed by the removal of parcels 102.

Once all of the contents of the parcels have been removed, the container 10/100 may be disposed of and replaced with a similar container possibly stored on the shelf behind the container 10/100.

It will be appreciated that the inclusion of the promotion means has meant that the size of the container 10/100 can be smaller than traditional containers used to house such articles whilst overcoming the problems associated with accessing the rearmost articles, stored therein.

It will of course be realised that the above has been given only by way of illustrative example of the present invention and that all such modifications and variations thereto as would be apparent to persons skilled in the art are deemed to fall within the broad scope and ambit of this invention as claimed in the following claims.

What is claimed is:

1. A container for storing a plurality of articles therein, said articles been arranged in rows one on top of the other and wherein each row includes a plurality of articles arranged one behind the other, said container including:

a top wall;

a bottom wall;

spacing means adapted to maintain said top wall in a desired spaced relationship relative to said bottom wall, and promotion means for promoting simultaneously the rearmost articles in each of the rows generally in a forward direction so as to fill a void created by removal of the foremost articles from the container.

2. A container as claimed in claim 1, wherein said promotion means includes an elongate member having a trailing portion adapted to engage the rearmost article contained in each row and a leading portion upon which some of said articles rest, said leading portion being capable of movement relative to said bottom wall in a generally forward direction.

3. A container as claimed in claim 2, wherein said trailing portion comprises a first portion which is fixed to said container and a second or intermediate portion connecting said first portion and said leading portion.

4. A container as claimed in claim 2, wherein said leading portion is located intermediate two of the rows.

5. A container as claimed in any one of claims 2, wherein said leading portion is constructed from paper card and includes a plurality of detachable portions arranged end to end.

6. A container as claimed in claim 5, wherein said container is manufactured from paper card and is assembled from a blank state.

7. A container as claimed in claim 1, wherein said spacing means comprises at least one wall attached to both said top and said bottom walls.

8. A container as claimed in claim 1, wherein said container includes a rear wall and a removable front wall.

9. A container for storing a plurality of articles therein, said articles been arranged in rows one on top of the other and wherein each row includes a plurality of articles arranged one behind the other, said container including:

a top wall;

a bottom wall;

a spacer adapted to maintain said top wall in a desired spaced relationship relative to said bottom wall, and an advancement mechanism in operable engagement with articles in at least one of the rows for simultaneously advancing the rearmost articles in each of the rows generally in a forward direction so as to fill a void created by removal of the foremost articles from the container.

10. A container as claimed in claim 9, wherein said advancement mechanism includes an elongate member having the trailing portion adapted to engage the rearmost article contained in each row and a leading portion upon which some of said articles rest, said leading portion being capable of movement relative to said bottom wall in a generally forward direction.

11. A container as claimed in claim 10, wherein said trailing portion comprises a first portion which is fixed to said container and a second or intermediate portion connecting said first portion and said leading portion.

12. A container as claimed in claim 10, wherein said leading portion is located intermediate two of the rows.

13. A container as claimed in claim 10, wherein said leading portion is constructed from paper card and includes a plurality of detachable portions arranged end to end.

14. A container as claimed in claim 13, wherein said container is manufactured from paper card and is assembled from a blank state.

15. A container as claimed in claim 9, wherein said spacer comprises at least one wall attached to both said top and said bottom walls.

16. A container as claimed in claim 9, wherein said container includes a rear wall and a removable front wall.

* * * * *